United States Patent [19]

Häusler et al.

[11] Patent Number: 4,830,294

[45] Date of Patent: May 16, 1989

[54] CAP TO COVER ALL SIDES OF THE END OF A SUPPORTING BODY OF A HAMMER MILL ROTOR

[75] Inventors: Dietrich Häusler, Vellmar; Helmut Manschwetus, Fuldabrück, both of Fed. Rep. of Germany

[73] Assignee: Thyssen Industrie AG, Essen, Fed. Rep. of Germany

[21] Appl. No.: 214,638

[22] Filed: Jul. 1, 1988

[30] Foreign Application Priority Data

Jul. 3, 1987 [DE] Fed. Rep. of Germany ..... 3721961

[51] Int. Cl.[4] ..... B02C 13/04

[52] U.S. Cl. ..... 241/194; 241/300

[58] Field of Search ..... 241/189 R, 191, 192, 241/193, 194, 197, 300

[56] References Cited

U.S. PATENT DOCUMENTS

| | | | |
|---|---|---|---|
| 3,727,845 | 4/1973 | Francis | 241/194 |
| 4,056,232 | 11/1977 | Linnerz et al. | 241/194 |
| 4,222,530 | 9/1980 | Whitney | 241/194 |
| 4,613,088 | 9/1986 | Hausler et al. | 241/194 X |
| 4,650,129 | 3/1987 | Newell et al. | 241/194 X |

FOREIGN PATENT DOCUMENTS 3438706 4/1986 Fed. Rep. of Germany .

*Primary Examiner*—Mark Rosenbaum

*Attorney, Agent, or Firm*—Becker & Becker, Inc.

[57] ABSTRACT

A cap to cover all sides of the end of a supporting body of a hammer mill rotor. The cap has two side walls, each end of which is provided with an approximately rectangular opening. In the direction of rotation of the rotor, the cap has a forward transverse wall and a rear transverse wall, each of which is provided with openings for a securing element or a plug. Each transverse wall also has a planar, inwardly directed surface, with these surfaces being directed approximately toward the center of the rotor and forming equal acute angles symmetrically relative to a plane that extends through the hammer shaft and an axis of rotation of the rotor. The inwardly directed surface of the forward transverse wall rests upon a forward end face of the supporting body. A filler member having a rectangular cross-sectional shape fills the gap between the rear inwardly directed surface and a planar rear abutment surface of the supporting body. The filler member has a surface that extends at the equal acute angle, and upon which the rear inwardly directed surface rests. The filler member establishes a positive connection between the cap and the supporting body.

3 Claims, 4 Drawing Sheets

CAP TO COVER ALL SIDES OF THE END OF A SUPPORTING BODY OF A HAMMER MILL ROTOR

BACKGROUND OF THE INVENTION

The present invention relates to a cap for covering all sides of the end of a supporting body of a hammer mill rotor that has a plurality of supporting body ends disposed next to one another and staggered in the direction of rotation of the rotor, with hammer shafts being mounted in the supporting body ends and extending parallel to the axis of rotation of the rotor over the length of the rotor. A respective hammer is mounted, in such a way that it can swing, between each two spaced apart supporting body ends that are disposed parallel to one another.

With hammer mill rotors, such caps are used to reduce the wear at the ends of the supporting bodies that occurs during operation, and to avoid time consuming repairs, such as the welding or sputtering of wear-resistant material onto these supporting body ends.

German Offenlegungsschrift No. 34 38 706 discloses a cap for covering supporting body ends; the side faces of this cap are provided with openings through which the hammer shafts extend in the installed state. With this type of securement, the centrifugal forces that result on the cap during operation are transmitted from the side faces onto the hammer shaft, and from there to the supporting bodies.

U.S. Pat. No. 3,727,848 discloses a cap that covers only a portion of the peripheral surface of the supporting body and only the forward supporting body end face as viewed in the direction of rotation of the rotor. Securement of this cap is effected by inserting beads or abutments that are disposed on both sides of a web into corresponding lateral recesses of a socket in the supporting body; when the hammer shaft is installed, it keeps the cap from falling out.

The drawback of these heretofore known caps is that depending upon how the rotor is assembled, the hammer shafts that hold the cap or secure it in position must be entirely or at least partially removed in order to replace the cap. However, such a removal of the hammer shafts is very time consuming and is particularly disruptive if, due to nonuniform wear of the caps, only a single cap is to be replaced and the remaining caps, which have not become worn, also have to be loosened, although they can remain on the rotor.

It is therefore an object of the present invention to provide a cap of the aforementioned general type that can be removed and replaced without having to remove the hammer shafts.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
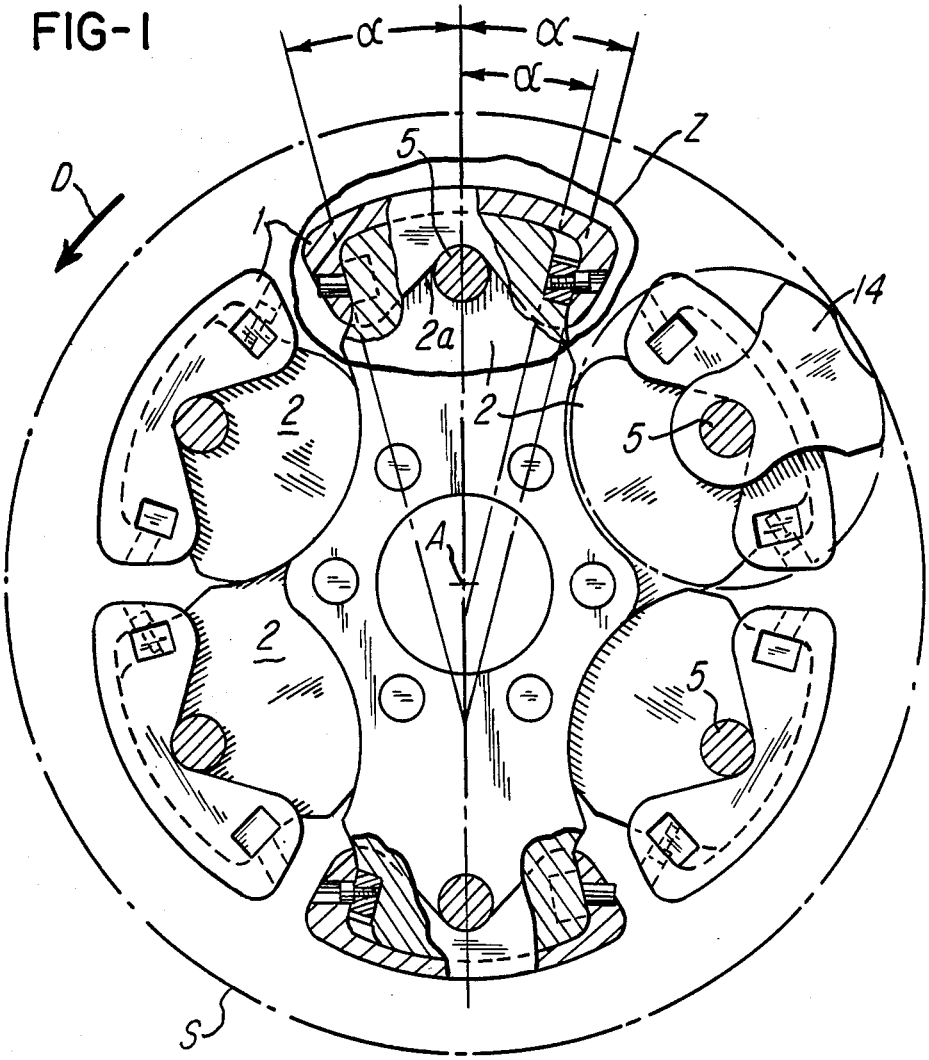
FIG. 1 is a cross-sectional end view through one exemplary embodiment of a hammer mill rotor with side views of plate-like supporting bodies, which are staggered in the circumferential direction, and inventive caps that are positively connected.

The present invention is characterized primarily in that: the cap has two side walls, with a free space being provided between the side walls and a hammer shaft; each side wall has two ends, each of which is provided with an approximately rectangular opening having an inside width or aperture size that is greater than the cross-sectional area of a filler member that is to be accommodated in the opening; the cap also has, as seen in the direction of rotation of the rotor, a forward transverse wall and a rear transverse wall, with these transverse walls being provided with openings for selectively receiving a securing element or a plug; the forward transverse wall has a planar inwardly directed surface, and the rear transverse wall has a planar inwardly directed surface, with these planar, inwardly directed surfaces, which are directed approximately toward the center of the rotor, forming equal acute angles symmetrically relative to a plane that extends through the hammer shaft and an axis of rotation of the rotor; the supporting body has a forward end face that extends at the equal acute angle and upon which the planar, inwardly directed surface of the forward transverse wall rests; and a filler member that has a rectangular cross-sectional shape and fills the gap between the planar, inwardly directed surface of the rear transverse wall and a planar rear abutment surface of the supporting body, which abutment surface extends parallel to the rear inwardly directed surface; the filler member has a surface that extends at the equal acute angle and upon which the planar, inwardly directed surface of the rear transverse wall rests, with the filler member establishing a positive connection between the cap and the supporting body.

The advantages achieved with the present invention consist in that the cap, to secure its position and to transfer centrifugal forces that are produced on the cap during operation, is positively connected to the supporting body by a filler member that is of straightforward construction and that can easily be mounted without first having to remove the hammer shaft. The contour of the supporting body can be produced in a straightforward manner, for example by flame cutting. Due to the symmetrical construction of the cap, the latter can be used as a reversible cap, thus significantly extending its useful life.

To prevent unintentional loosening of the cap, it is proposed pursuant to a specific embodiment of the present invention that the filler member be positively secured by an element that can be removed during disassembly and that extends into the opening in the rear transverse wall. As a result of this embodiment, the filler member is prevented from falling out to the side.

Furthermore, to protect the side faces of the supporting body, it is proposed that those openings in the side walls that are disposed toward the front when viewed in the direction of rotation of the rotor, be adapted to be sealed or closed off by cover means that are held in a positive manner.

Further specific features of the present invention will be described in detail subsequently.

DESCRIPTION OF PREFERRED EMBODIMENTS

Referring now to the drawings in detail, in the cross-sectional end view of FIG. 1 through a hammer mill rotor, the plate-like supporting bodies 2 are staggered relative to one another in the circumferential direction. The ends 2*a* of the supporting bodies 2 are provided with positively connected caps 1. The hammer shafts 5 extend over the length of the rotor and are mounted in the ends 2*a* of the supporting bodies 2; hammers 14 that can swing are pivotably mounted on the shafts 5. Also indicated are the axis of rotation A of the rotor, the direction of rotation D of the rotor, and the path S of the hammers 14.

Figure 2:
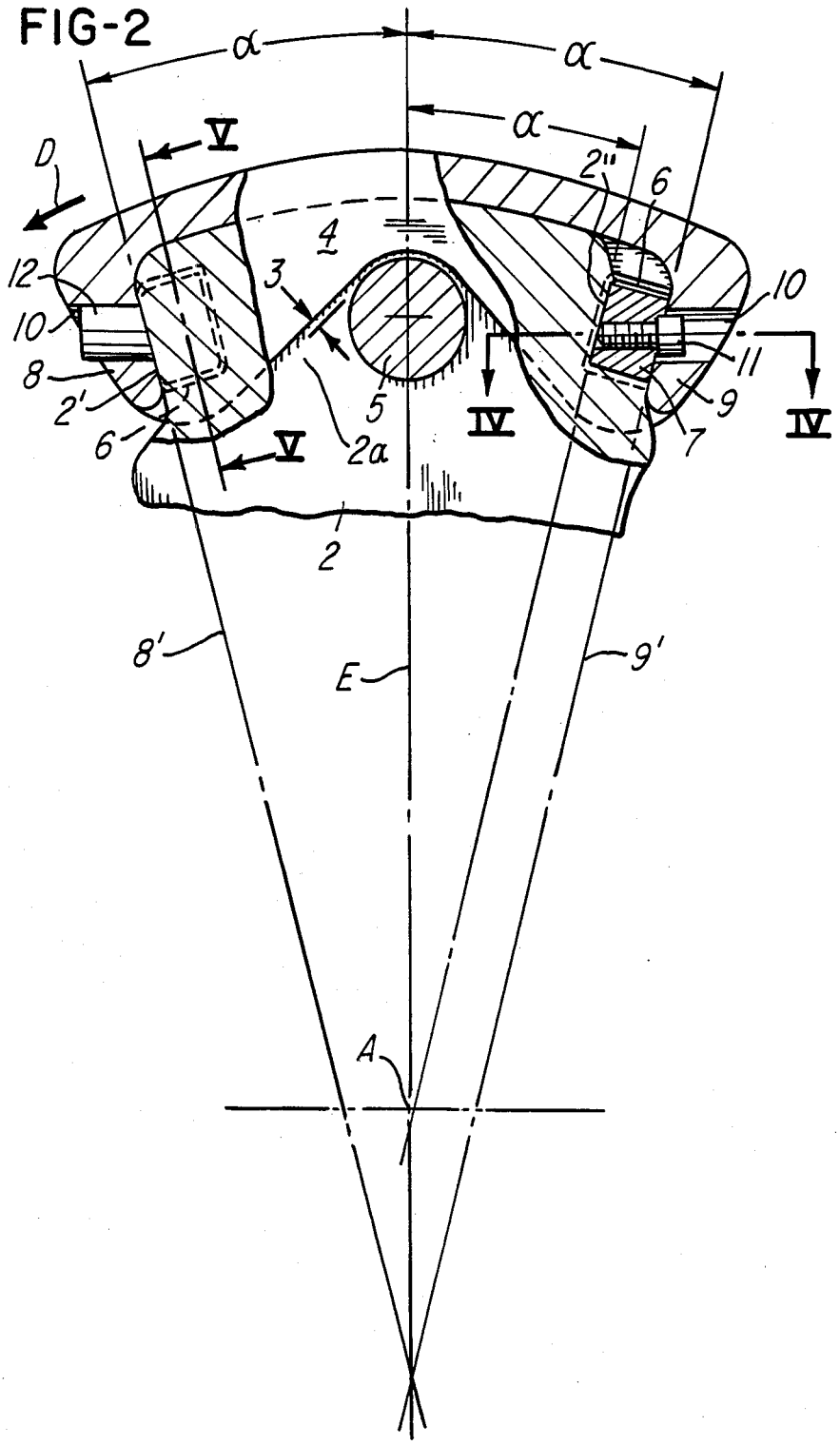
FIG. 2 is a detailed view of the portion indicated by Z in FIG. 1.
Figure 3:
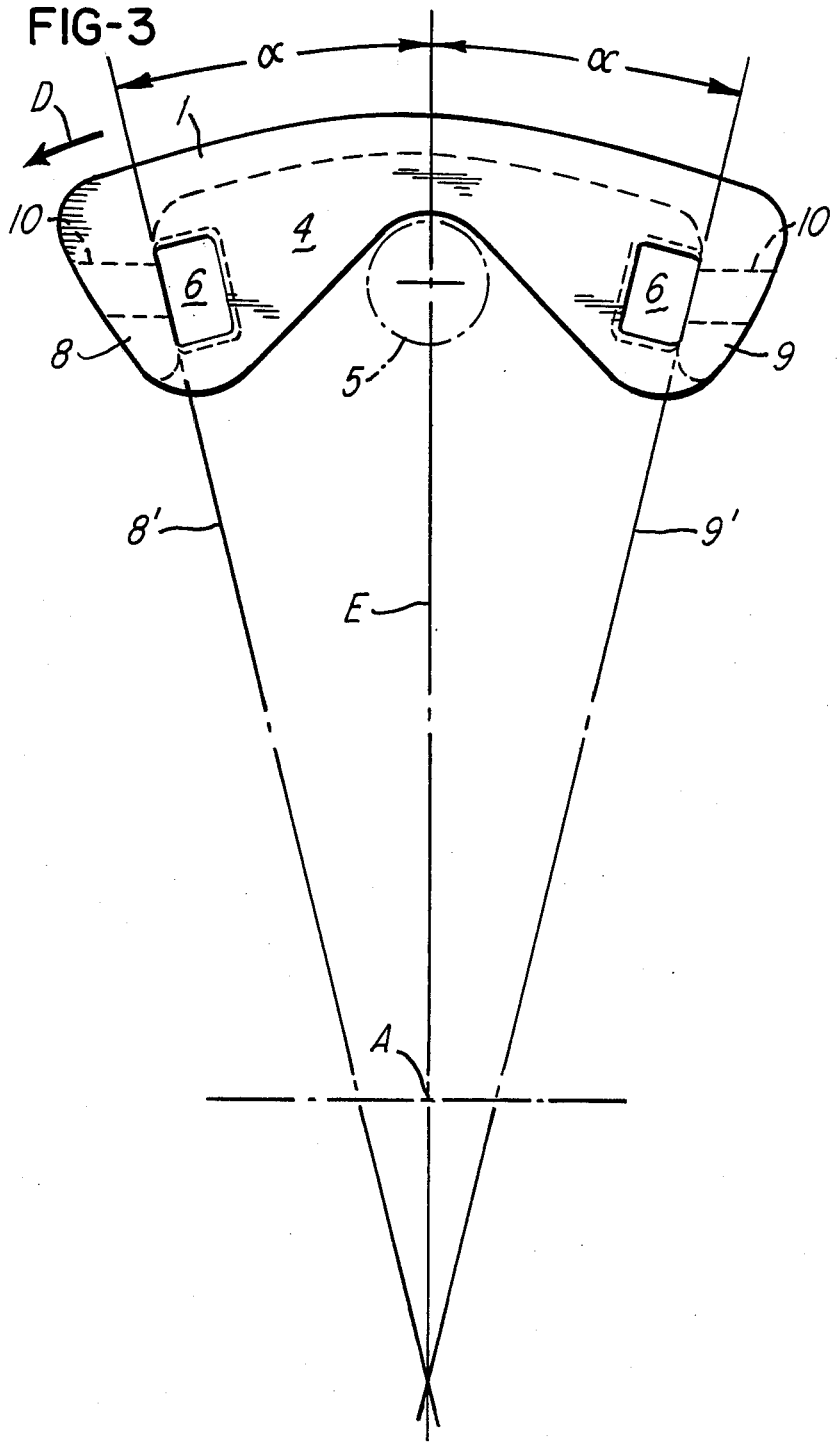
FIG. 3 is a side view of one exemplary embodiment of the inventive cap.
Figure 4:
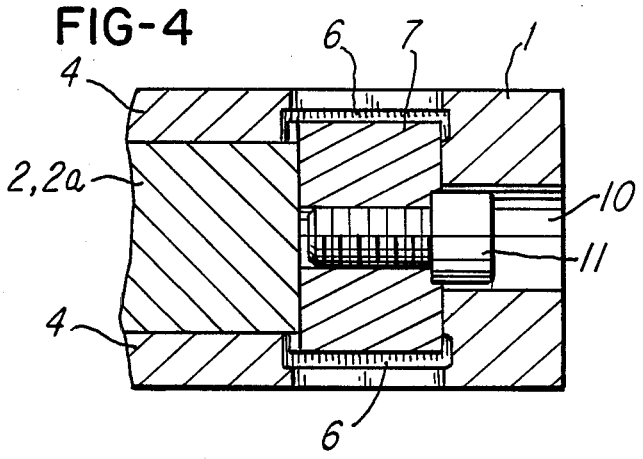
FIG. 4 is an enlarged cross-sectional view taken along the line IV—IV in FIG. 2.

The enlarged detailed view in FIG. 2 of the portion Z of FIG. 1 shows the connection or mounting of a cap 1. The cap 1 covers the end 2*a* of the supporting body 2 on all sides. The central portion of the side walls 4 of the cap 1 is somewhat narrower than are the ends of the cap, and is provided with a free space 3 for the hammer shaft 5. Provided at both ends of the side walls 4 are nearly rectangular openings 6 (see also FIG. 3). The cap 1 is furthermore provided with a forward transverse wall 8 and a rear transverse wall 9, with the terms "forward" and "rear" being relative to the direction of rotation D of the rotor. The planar inner surface 8' of the forward transverse wall 8, and the planar inner surface 9' of the rear transverse wall 9, form the same acute angle $\alpha$ symmetrically to the plane E that extends through the hammer shaft 5 and the axis of rotation A of the rotor. In this connection, the inner surfaces 8' and 9' of the transverse walls 8 and 9 are directed toward the center of the rotor.

The planar inner surface 8' of the forward transverse wall 8 rests against the end face 2' of the supporting body 2; this end face 2' also extends at the equal angle $\alpha$. The planar inner surface 9' of the supporting body 2 rests upon the surface of a filler member 7; this surface also extends at the equal angle $\alpha$, and the filler member 7 fills the gap between the planar inner surface 9' and the abutment surface 2'' of the supporting body 2, with this planar abutment surface 2'' for this purpose extending parallel to the planar inner surface 9'. The filler member 7 has a rectangular cross-sectional shape, and in the installed state establishes a positive connection between the cap 1 and the supporting body 2; this positive connection prevents the cap 1 from loosening under the effect of the centrifugal force that results during operation.

In order to prevent an unintentional loosening of the cap 1, an element 11 is secured in the filler member 7. This element 11, which in the illustrated embodiment is a screw, extends into the opening 10 of the rear transverse wall 9, and can be inserted or retracted from the outside.

To prevent the material that is to be crushed from damaging the end face 2' of the supporting body 2, a plug 12 is inserted in the opening 10 of the forward transverse wall 8. When the forward transverse wall 8 has become worn away, the cap 1, after the lateral removal of the filler member 7, can be lifted radially outwardly by sliding it along the surfaces 8'/2', and can again be placed upon the supporting body 2 after it has been turned by 180°. The plug 12 should first be removed and possibly be replaced by a new plug that is to be inserted into the now forwards opening 10 of the previously rear transverse wall 9, which now becomes the forward transverse wall. After the cap 1 has been turned, the filler member 7 is reinserted and is again prevented from falling out to the side by the element 11.

Figure 5:
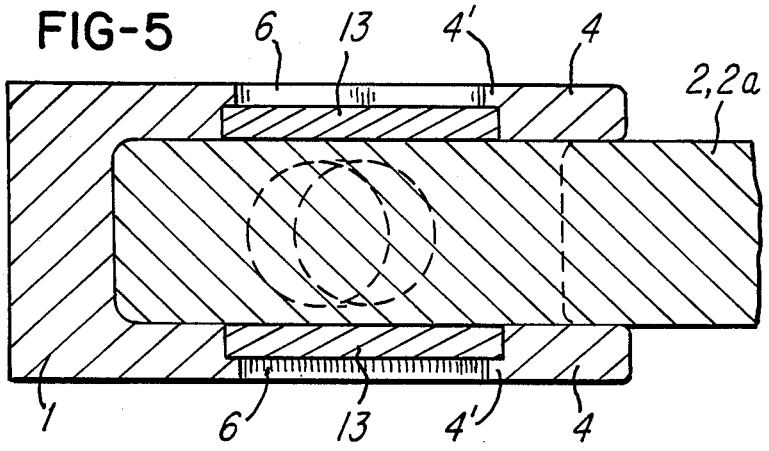
FIG. 5 is an enlarged cross-sectional view taken along the line V—V in FIG. 2.

As shown in the enlarge cross-sectional view of FIG. 5, in order to prevent dirt and material that is to be crushed from entering the region of the openings 6 in the side walls 4 of the cap 1, these openings 6 are closed off by cover means 13 that are disposed between the side faces of the supporting body 2 and the shoulders 4' of the side walls 4 in such a way that they cannot fall out.

The present invention is, of course, in no way restricted to the specific disclosure of the specification and drawings, but also encompasses any modifications within the scope of the appended claims.

What we claim is:

1. In a cap to cover all sides of the end of a supporting body of a hammer mill rotor that has a plurality of supporting body ends disposed next to one another and staggered in the axis of rotation of said rotor, with hammer shafts being mounted in said supporting body ends and extending parallel to said axis of rotation of said rotor over the length of said rotor, and with respective hammers being mounted, in such a way that they can swing, between each two spaced apart supporting body ends that are disposed parallel to one another, the improvement comprising:

a cap that has two side walls, with a free space being provided between said side walls and a hammer shaft in the installed state; each side wall has two ends, each of which is provided with an approximately rectangular opening having an aperture size that is greater than the cross-sectional area of a filler member that is to be accommodated in said opening; said cap also has, as seen in the direction of rotation of said rotor, a forward transverse wall and a rear transverse wall, with each of said transverse walls being provided with opening means for selectively receiving a securing element or a plug; said forward transverse wall has a planar, inwardly directed surface, and said rear transverse wall also has a planar, inwardly directed surface, with said two planar, inwardly directed surfaces, which are directed approximately toward the center of said rotor, forming equal acute angles symmetrically relative to a plane that extends through said hammer shaft and an axis of rotation of said rotor; said supporting body has a forward end face that extends at said equal acute angle and upon which said planar, inwardly directed surface of said forward transverse wall rests; and a filler member that has a rectangular cross-sectional shape and fills the gap between said planar, inwardly directed surface of said rear transverse wall and a planar, rear abutment surface of said supporting body, which abutment surface extends parallel to said inwardly directed surface of said rear transverse wall; said filler member has a surface that extends at said equal acute angle and upon which said planar, inwardly directed surface of said rear transverse wall rests, with said filler member establishing a positive connection between said cap and said supporting body.

2. A cap according to claim 1, which, for positively securing said filler member in said openings of said side walls of said cap, includes a securing element that extends into said opening means of said rear transverse wall and that can be removed for removal of said cap.

3. A cap according to claim 2, which includes cover means for closing off, in a positively held manner, said openings in the forward ends of said side walls of said cap.

* * * * *